US006190218B1

(12) United States Patent
Hall et al.

(10) Patent No.: US 6,190,218 B1
(45) Date of Patent: Feb. 20, 2001

(54) PUMP JET WITH REDIRECTED EXHAUST GAS THROUGH STATOR VANE FOR DRAG REDUCTION

(75) Inventors: Kimball P. Hall, Wading River, NY (US); A. Michael Varney, Sewall's Point; John D. Martino, Longwood, both of FL (US)

(73) Assignee: Outboard Marine Corporation, Waukegan, IL (US)

( * ) Notice: Under 35 U.S.C. 154(b), the term of this patent shall be extended for 0 days.

(21) Appl. No.: 09/406,582

(22) Filed: Sep. 27, 1999

(51) Int. Cl.[7] ..... B63H 1/16
(52) U.S. Cl. ..... 440/67; 440/89
(58) Field of Search ..... 440/67, 89, 66; 60/221; 416/93 R, 93 A

(56) References Cited

U.S. PATENT DOCUMENTS

| | | | | |
|---|---|---|---|---|
| 3,658,028 | | 4/1972 | Koons | 115/42 |
| 3,943,876 | | 3/1976 | Kiekhaefer | 115/12 R |
| 4,304,558 | | 12/1981 | Holtermann | 440/67 |
| 4,600,394 | * | 7/1986 | dritz | 440/38 |
| 4,643,685 | | 2/1987 | Nishida | 440/42 |
| 4,832,570 | | 5/1989 | Solia | 416/93 A |
| 4,931,026 | | 6/1990 | Woodland | 440/38 |
| 5,273,467 | | 12/1993 | Hall | 440/89 |
| 5,325,662 | | 7/1994 | Varney et al. | 60/221 |
| 5,482,482 | | 1/1996 | Davis | 440/67 |

FOREIGN PATENT DOCUMENTS

| | | |
|---|---|---|
| 722842 | 7/1942 | (DE) . |
| 748218 | 10/1944 | (DE) . |
| 0298053 | 4/1989 | (EP) . |
| 20843 | 9/1907 | (GB) . |
| 1-273788 | 11/1989 | (JP) . |

* cited by examiner

*Primary Examiner*—Sherman Basinger
(74) *Attorney, Agent, or Firm*—John H. Pilarski; Dennis M. Flaherty

(57) ABSTRACT

An ETV-type pump jet having a stator housing with an attachment for minimizing the mismatches between the velocity and direction of the exhaust gas stream flowing out of a stator vane outlet and the velocity and direction of boat and pump jet motion. In one embodiment, a multiplicity of exhaust ducts are attached to the external surface of the stator housing, each exhaust duct being positioned to be in flow communication with the exhaust gas outlet of a respective hollow stator vane. Exhaust gases exiting the exhaust outlets are redirected by the inner surfaces of the ducts to flow in parallel with the rotor shaft axis. In another embodiment, a circumferential exhaust skirt made of sheet metal is substituted for the exhaust ducts. The exhaust skirt surrounds the stator housing and redirects the exhaust gas stream to be substantially parallel with the surrounding water flow.

20 Claims, 8 Drawing Sheets

PUMP JET WITH REDIRECTED EXHAUST GAS THROUGH STATOR VANE FOR DRAG REDUCTION

FIELD OF THE INVENTION

This invention generally relates to pump jets used with outboard motors or in inboard/outboard or stern drive units of boats and other vehicles. In particular, the invention relates to pump jets in which exhaust gas from the motor is directed through the pump jet and discharged into the water stream surrounding the pump jet.

BACKGROUND OF THE INVENTION

In one type of conventional outboard motor, a propeller is driven by a powerhead to propel a boat through water. Most large outboard motors of this type inject the exhaust gas stream under water in order to reduce engine noise and increase propulsive thrust.

In a typical configuration shown in FIG. 1, the gas exhausted from the powerhead 10 flows downwardly through an exhaust channel 12 and exits the motor rearwardly through the propeller 14. This type of motor is referred to as an exhaust-through-hub (ETH) motor.

Another type of conventional outboard motor has an axial-flow pump jet system driven by the powerhead. In a pump jet system, an impeller or rotor is mounted (e.g., spline fitted) directly on the propeller output shaft in place of the propeller. There are typically no modifications to the drive train, cooling or sealing components. A ducted housing surrounds the rotor. Such a system has the advantages of reducing hazards to swimmers in the vicinity of the motor, protecting the rotating elements from interference with and damage by foreign objects in the water, and improving the efficiency and performance of the propulsion system. Another benefit inherent with the pump jet is a directed jet of water that results in greater steering response.

U.S. Pat. No. 5,325,662 discloses a pump jet in which the exhaust gas discharged from the outboard motor is ducted downwardly through the central body of the motor and around a rotor shaft. An annular exhaust channel is formed in the rotor hub for receiving the exhaust gas and projecting it rearwardly of the motor. A cavity in the stator hub provides a plenum chamber for receiving the exhaust gas. Exhaust gas flows from the cavity of the stator hub to at least one hollow stator vane which serves as an exhaust pipe. In the case of multiple hollow stator vanes, the flow in the stator hub is split into multiple streams. Each stream of exhaust gas passes through a respective hollow stator vane. Discharge ports are formed in the stator housing for discharging exhaust gas into the water stream surrounding the stator housing. This arrangement will be referred to herein as an exhaust-through-vane (ETV) configuration.

The ETV configuration works well in practice. But the cross-sectional area of the hollow passages in the assemblage of hollow stator vanes is limited by practical considerations, with the result that the velocity of the gas streams exiting from the vanes must be several times greater than the velocity of the boat and pump jet through the water. There is a mismatch between boat velocity and exhaust gas velocity, so the exhaust gas stream must slow down, and in doing so, the exhaust gas stream "bushes out" and presents a significant added frontal area to the water stream, producing added drag. There is also a mismatch in the direction of the exhaust gas flow, which further adds to the frontal area of the gas stream, producing more drag.

Thus, there is a need for an improvement to an ETV-type pump jet which will minimize the mismatch in velocity and the mismatch in direction, thereby enhancing motor performance.

SUMMARY OF THE INVENTION

The present invention is an ETV-type pump jet having means for minimizing the mismatches between the velocity and direction of the exhaust gas flow and the velocity and direction of boat and pump jet motion. As used herein, the term "ETV-type" includes both "exhaust-through-vane" and "exhaust-through-strut" types of pump jet.

In accordance with one preferred embodiment of the invention, exhaust ducts are attached to the external surface of the stator housing. Each exhaust duct is positioned to be in flow communication with the exhaust gas outlet of a respective hollow stator vane. The exhaust ducts may be attached by welding or brazing, by fastening (e.g., using bolts or screws), or by any other conventional attachment means. As used herein, the term "exhaust duct" is not a tubular channel, which is the normal sense in which the term a "duct" is used, but rather is a portion of a duct which acts as a shield to allow the exhaust gases to discharge from the exhaust outlets free of interaction with the water stream external to the stator housing. The outlet of each exhaust duct is defined by the trailing edge of the duct and the opposing external surface of the stator housing.

Preferably, each exhaust duct comprises a curved piece of sheet material, e.g., metal, having a three-dimensional curved edge which abuts the external surface of the stator housing along a contour which partly surrounds the exhaust outlet of a corresponding hollow stator vane, and having an arc-shaped or eyebrow-shaped trailing edge which preferably lies in a plane perpendicular to the axis of the rotor shaft. Preferably, the duct material is a portion of a circular cylindrical surface and lies substantially parallel to the rotor shaft axis (i.e., the pump jet central axis). However, the ducts need not be sections of a circular cylinder. Other shapes may be used to decrease the cross-sectional area of the outlet formed by the stator housing and the trailing edge of each duct.

In the case where the ducts are circular cylindrical, exhaust gases exiting the exhaust outlets are redirected by the inner surfaces of the ducts to flow in parallel with the rotor shaft axis, i.e., in parallel with the direction of pump jet motion. In addition, the ducts provide a cross-sectional area for the exhaust gas stream which increases from adjacent the exhaust outlet to the duct outlet formed by the stator housing and the trailing edge of the exhaust duct. The result will be an exhaust gas stream which exits the exhaust duct parallel to and at a velocity equal to or less than that of the water stream flowing along the outer surface of the exhaust duct during forward motion of the pump jet (provided that the eyebrow-shaped ducts are properly sized). It is expected that the exhaust ducts in accordance with the preferred embodiment will achieve improved performance over the entire pump jet speed range.

In accordance with another preferred embodiment of the invention, an exhaust skirt is attached to the external surface of the stator housing. The exhaust skirt surrounds the stator housing, and is preferably coaxial with the stator housing. The skirt may be either circular cylindrical or conical with radius decreasing in the rearward direction. Exhaust gases exiting the exhaust outlets at the outer surface of the stator housing are redirected by the inner surface of the skirt to flow in parallel with the water flow at the trailing edge of the skirt. The exhaust skirt may be attached to the stator housing by welding or brazing, by fastening (e.g., using bolts or screws), or by any other conventional attachment means.

DETAILED DESCRIPTION OF THE PREFERRED EMBODIMENTS

Figure 1:
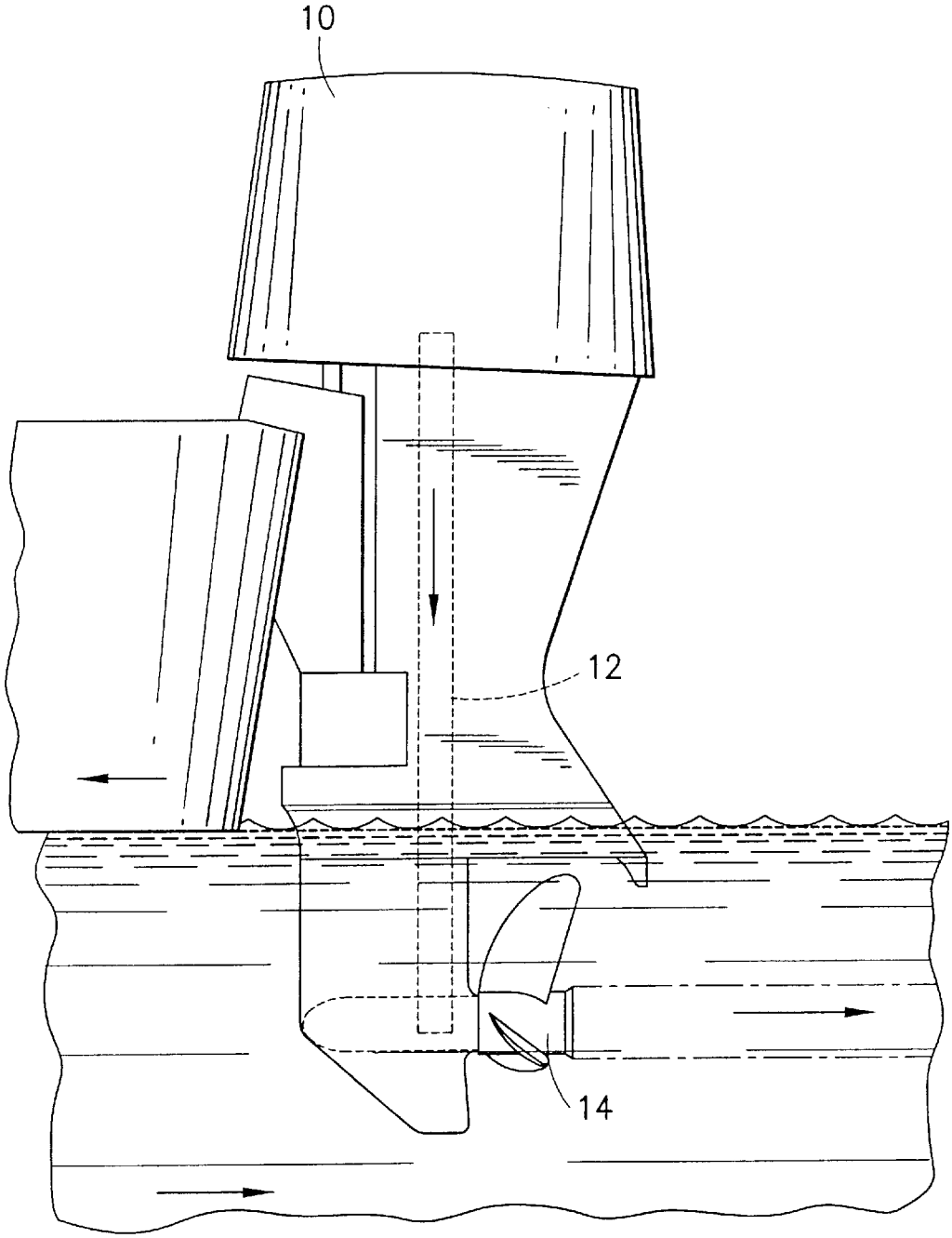
FIG. 1 PRIOR ART
FIG. 1 is a schematic view of a prior art ETH motor with a propeller.
Figure 2:
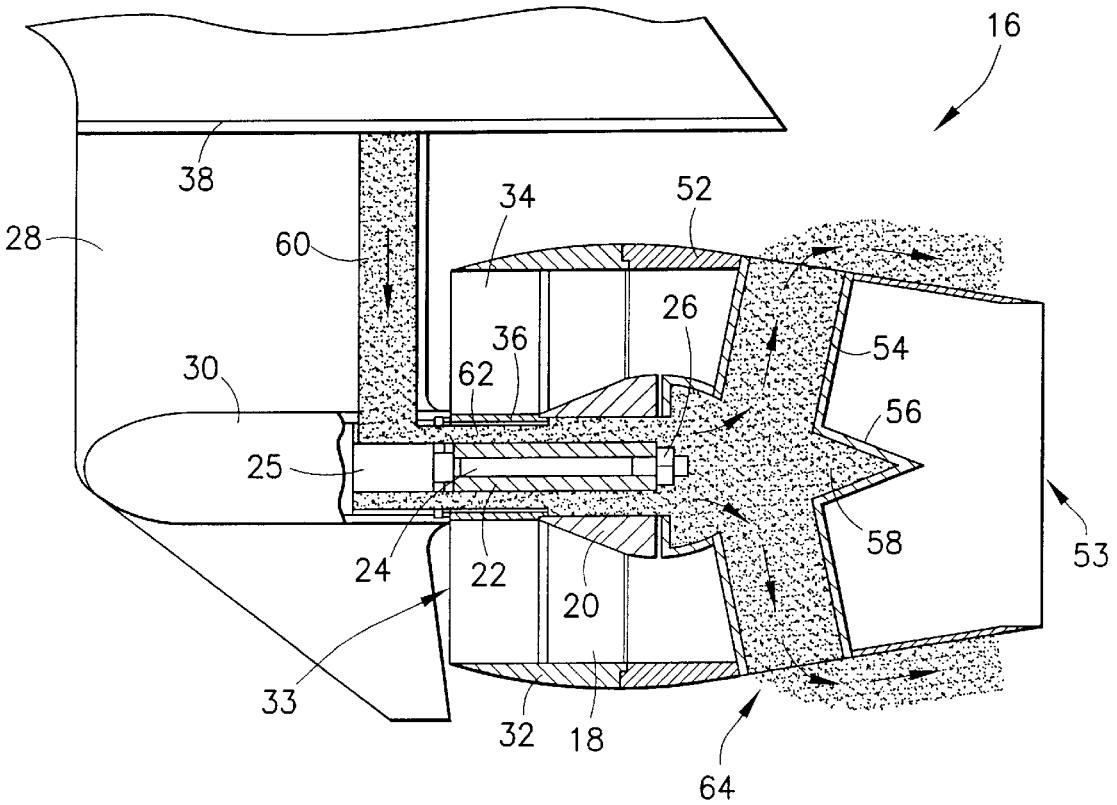
FIG.2 PRIOR ART
FIG. 2 is a partial sectional view of an ETV pump jet having exhaust streams discharged through at least two stator vanes.

The present invention relates to an outboard motor having a pump jet 16 of the ETV type shown in FIG. 2. The pump jet includes a rotor comprising a plurality of blades 18 extending radially outward from an outer rotor hub 20. The outer rotor hub 20 is securely mounted on an inner rotor hub 22. The rotor and inner rotor hub are assembled prior to installation. During pump jet installation, this one-piece rotor assembly is inserted onto one end of a propeller shaft 24 and secured to the shaft by a nut 26. The other end of the propeller shaft is rotatably mounted in a bearing (not shown) which is housed in propeller shaft bearing housing 25. Inner rotor hub 22 is connected to outer rotor hub 20 by means of radial struts, which are not visible in the partially sectional view of FIG. 2.

In conventional fashion, the powerhead 10 drives the propeller shaft 24 to rotate via a drive shaft and gears, neither of which are shown in FIG. 2. The drive shaft extends inside the lower housing unit 28, while the gears are arranged inside the gear case 30. Rotation of the propeller shaft in turn causes the rotor assembly to rotate. During rotation in forward gear, the angled blades 18 of the rotor impel water axially rearward to produce a forward thrust. In reverse gear, a reverse thrust is produced.

The rotor assembly is surrounded by a non-rotating rotor housing 32. The rotor housing 32 is part of a one-piece rotor housing assembly, which also comprises a plurality of inlet vanes 34 and an inlet vane hub 36. Each inlet vane 34 is joined at one end to the inlet vane hub 36 and at the other end to the rotor housing 32. The inlet vanes direct water flow into the blades 18 of the rotor. The inlet vanes also block debris, sea creatures or human limbs from contacting the rotating blades of the rotor.

Figure 3:
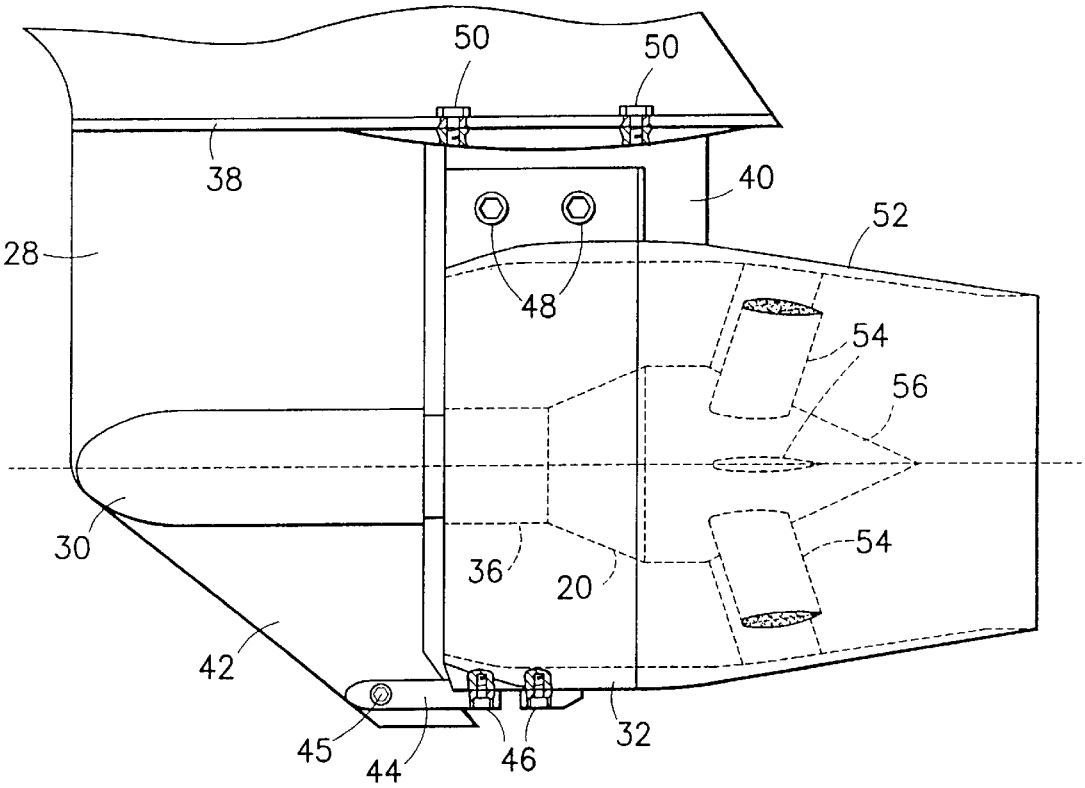
FIG.3 PRIOR ART
FIG. 3 is a side elevational view showing the manner of attachment of the pump jet of FIG. 2 to an outboard motor.
Figure 4:
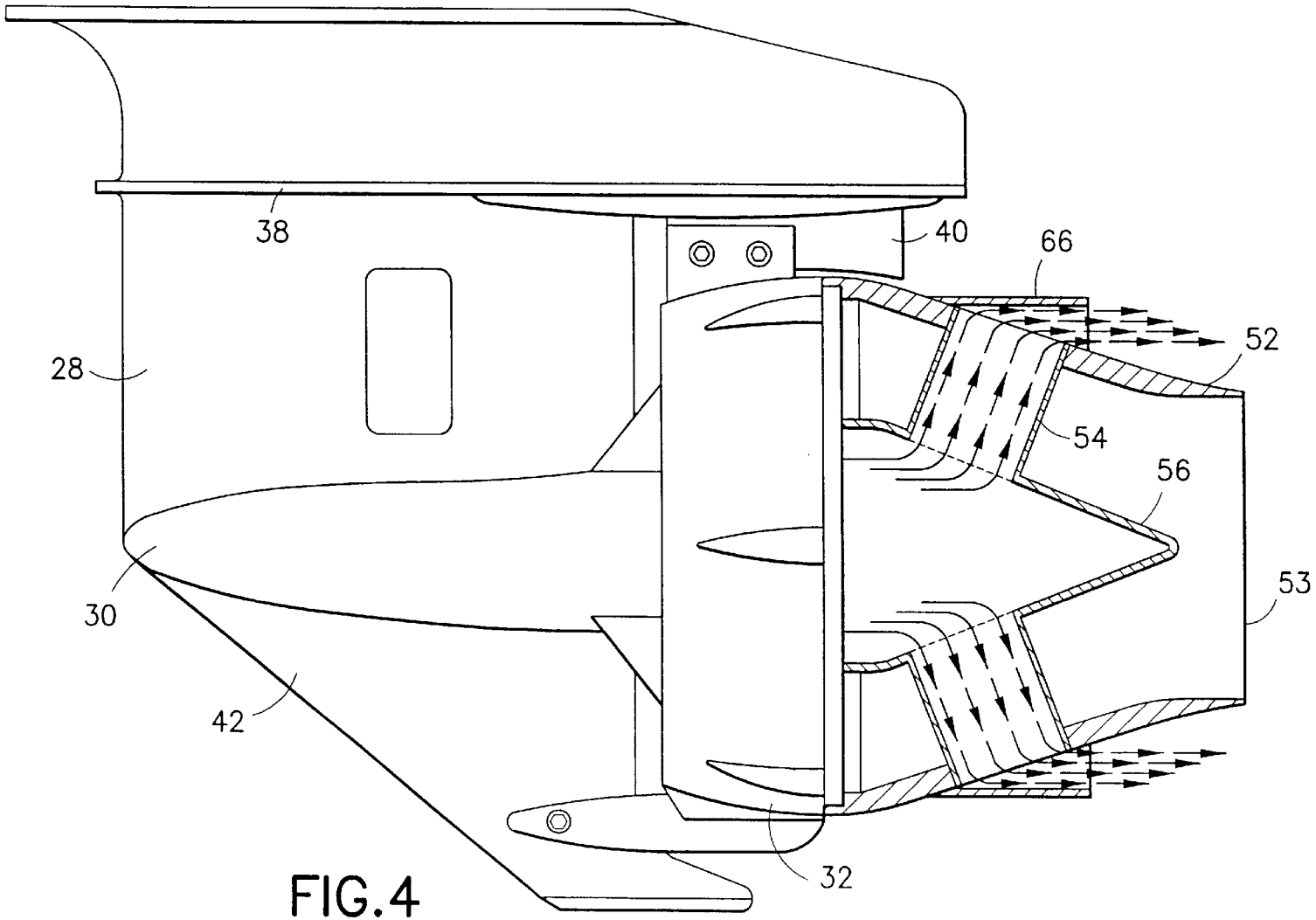
FIG. 4 is a partial sectional view of an ETV pump jet of the type shown in FIG. 2 having exhaust ducts in accordance with one preferred embodiment of the invention.
Figure 5:
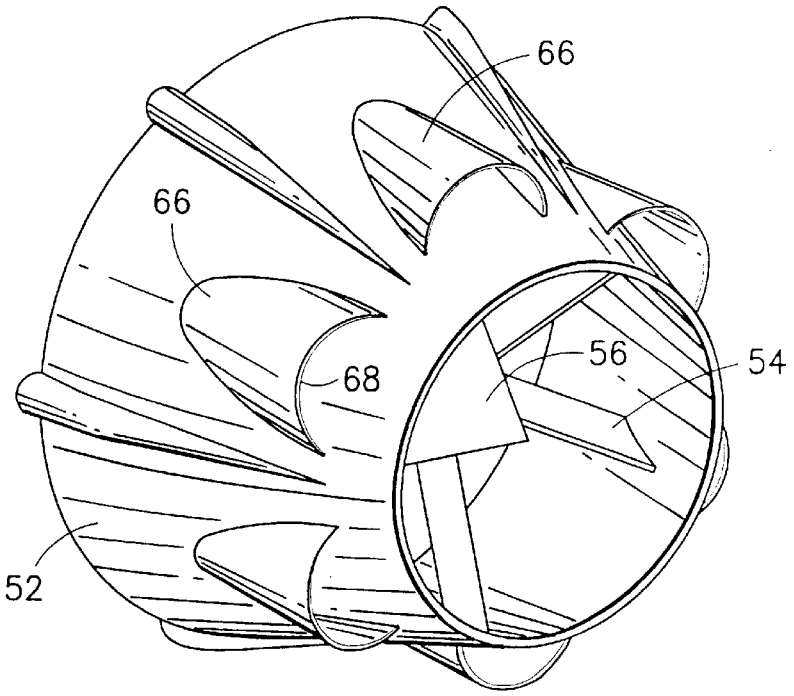
FIG. 5 is an isometric view of the stator housing in accordance with the preferred embodiment shown in FIG. 4.
Figure 6:
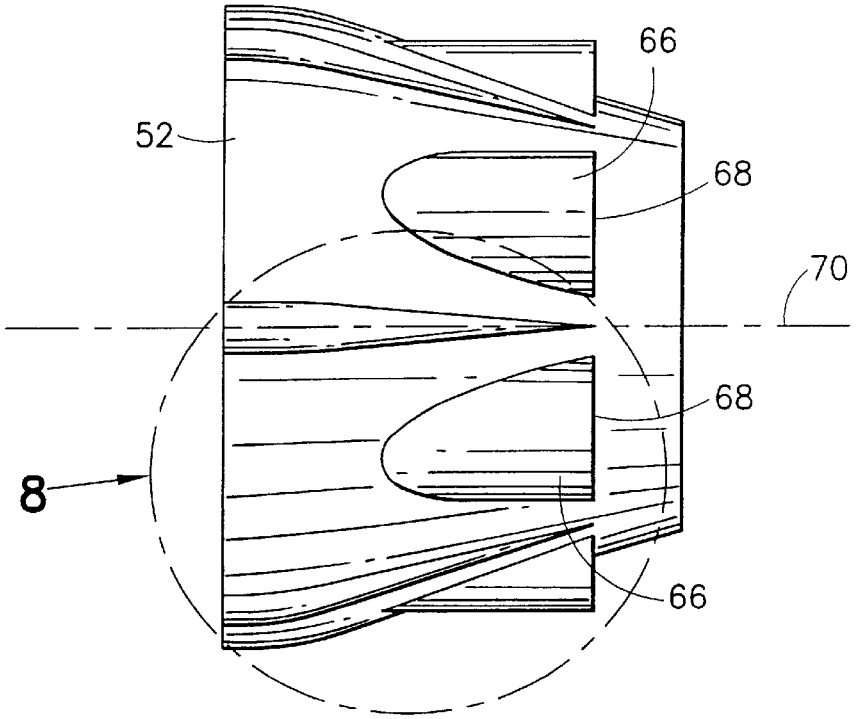
FIG. 6 is a side elevational view of the stator housing shown in FIG. 5.
Figure 7:
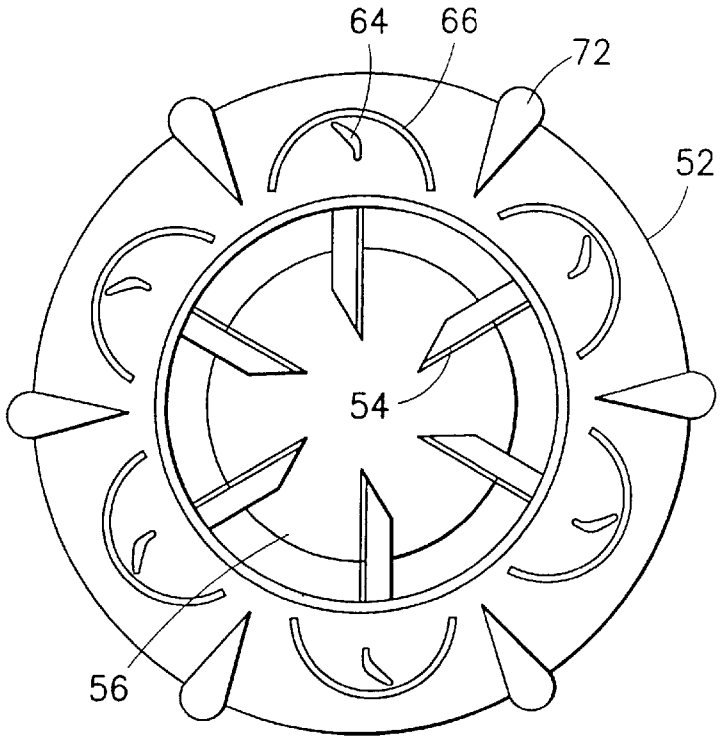
FIG. 7 is an end elevational view of the stator housing shown in FIG. 5.

During pump jet installation, the rotor housing assembly is installed prior to installation of the rotor assembly. The inlet vane hub 36 is inserted into the downstream end of the gear case 30. Referring to FIG. 3, the rotor housing assembly is joined to an anti-cavitation plate 38 by means of an upper bracket 40 and is joined to skeg 42 by means of a clamp 44. Screw 45 squeezes the clamp 44 onto the skeg 42. Screws 46 secure the clamp 44 to the rotor housing 32. Screws 48 and bolts 50 attach the upper bracket 40 to the anti-cavitation plate 38. Alternatively, the rotor housing assembly can be welded onto the lower unit.

Referring again to FIG. 2, the rotor housing 32, which has an inlet 33 for the intake of water, forms the upstream portion of the shroud which fully encloses the pump jet. The rearward portion of the shroud comprises a stator housing 52 which has an outlet 53 for the water propelled rearward by the rotor blades 18. The stator housing 52 has an upstream edge which form fits with the downstream edge of the rotor housing 32. Installation of a pump jet involves three steps: (1) attach the rotor housing to the anti-cavitation plate and skeg; (2) install the rotor on the propellor shaft; and (3) attach the stator housing to the rotor housing by means of screws (not shown in FIG. 2). The stator housing 52 has a generally conical portion which decreases in internal diameter in the downstream direction. The minimum internal diameter of stator housing 52 is preferably located at the outlet 53.

In accordance with the embodiment depicted in FIG. 2, the stator housing 52 is part of a one-piece stator housing assembly, which also comprises a plurality of stator vanes 54 and a stator hub 56. Each stator vane 54 is joined at one end to the stator hub 56 and at the other end to the stator housing 52. The stator vanes convert rotational energy imparted to the water flow by the rotor blades into axial flow energy at the outlet of the stator housing 52. One or more of the stator vanes 54 is hollow. Similarly, an internal cavity in the stator hub 56 forms a plenum cavity 58, which is in flow communication with each hollow stator vane. Nut 26 extends into plenum cavity 58 in stator hub 56.

The exhaust gas from the powerhead 10 flows downwardly through an exhaust channel 60. The lower end of the exhaust channel 60 is in flow communication with a hub exhaust channel 62 which channels the exhaust stream rearward through the hub. The hub exhaust channel 62 is an annular space, which is bounded internally by the propeller shaft bearing housing 25 and the inner rotor hub 22, and externally by the wall of the gear case 30, the inlet vane hub 26 and the outer rotor hub 20. The exhaust stream flows from the hub exhaust channel 62 to the plenum cavity 58 in stator hub 56, and then into the hollow stator vanes 54 which communicate with the plenum cavity. The exhaust stream in each hollow stator vane flows the length of the stator vane and discharges from a respective exhaust port 64 into the water stream surrounding the stator housing 52. Without further structural modification of the pump jet shown in FIG. 2, the exhaust gas stream will "bush out" and present a significant added frontal area to the water stream, producing added drag.

Alternatively, the stator housing may comprise two segments. The first stator housing segment is attached to the downstream edge of the rotor housing, while the second stator housing segment is attached to the downstream edge of the first stator housing segment. A plurality (e.g., 8) of stator vanes extend generally radially inward from the first stator housing segment. A plurality of hollow struts extend generally radially inward from the second stator housing segment and are connected to the stator hub. In accordance with this alternative arrangement, the exhaust stream flows from the plenum cavity in the stator hub into the hollow struts which communicate with the plenum cavity. The present invention has application in both situations, i.e., whether the exhaust stream flows through hollow stator vanes or hollow struts of the stator housing assembly.

In accordance with one preferred embodiment of the invention shown in FIGS. 4–8, exhaust ducts 66 are attached to the external surface of the stator housing 52. Each exhaust duct 66 is positioned to overlie the exhaust gas outlet 64 of a respective hollow stator vane 54 (or hollow strut). The exhaust ducts 66 may be attached by welding or brazing, by fastening (e.g., using bolts or screws), or by any other conventional attachment means. Preferably, each exhaust duct 66 comprises a curved piece of sheet material, preferably metal, having a three-dimensional curved edge which abuts the external surface of the stator housing 52 and is joined thereto (e.g., by tack welding) along a contour which partly surrounds the corresponding exhaust outlet 64; and having an arc-shaped or eyebrow-shaped trailing edge 68 (best seen in FIGS. 5 and 7) which preferably lies in a plane perpendicular to the axis of the pump jet. Preferably, the duct material is a concave segment of a cylindrical (e.g., circular cylindrical) surface and lies substantially parallel to the pump jet central axis 70. In this case, exhaust gases exiting the exhaust outlets will be redirected by the inner surfaces of the ducts to flow in parallel with the rotor shaft axis, i.e., in parallel with the direction of pump jet motion. In addition, the ducts provide a cross-sectional area for the exhaust gas stream which increases from a point adjacent the exhaust outlet to the duct outlet formed by the stator housing and the trailing edge of the exhaust duct. The result will be an exhaust gas stream which exits the exhaust duct parallel to and at a velocity equal to or less than that of the water stream flowing along the outer surface of the exhaust duct during forward motion of the pump jet (provided that the eyebrow-shaped ducts are properly sized).

Figure 8:
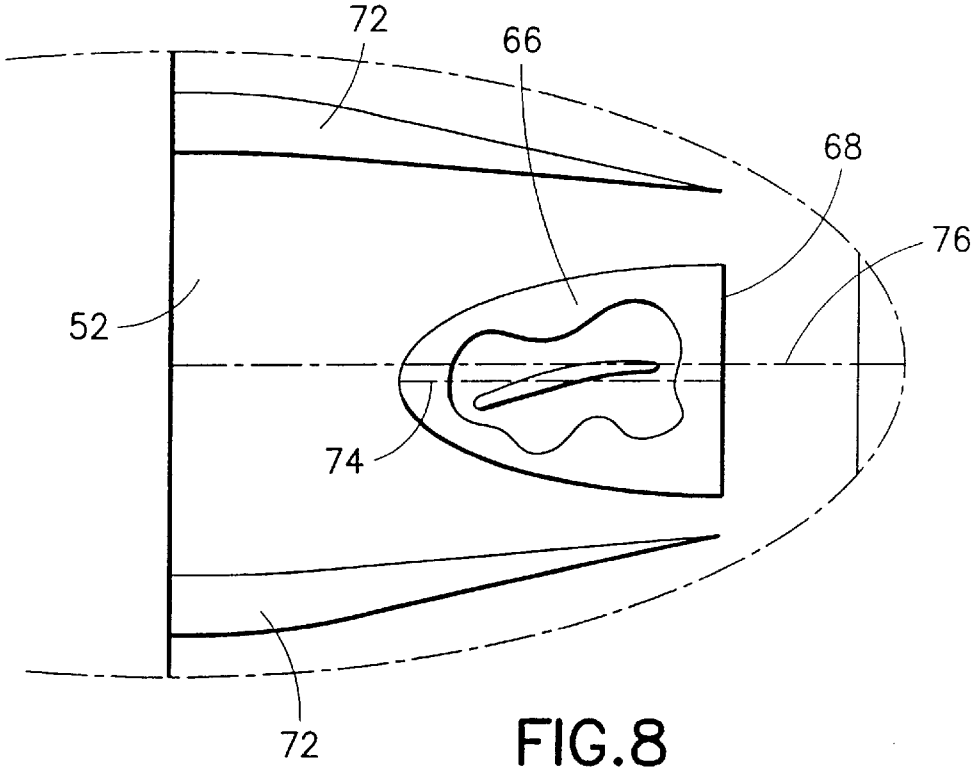
FIG. 8 is a schematic view of a portion of the stator housing shown in FIG. 5, including only one exhaust duct situated between a pair of ribs. A portion of the exhaust duct is cut away to reveal the exhaust outlet beneath it.

As best seen in FIG. 8, one exhaust duct 66 is situated between a pair of ribs 72 on the stator housing 52. Center line 74 is the line of symmetry of the eyebrow-shaped exhaust duct 66, while center line 76 is the line of symmetry between each pair of ribs 72 of the ETV stator housing. Preferably, center lines 74 and 76 are mutually parallel.

If a stator housing having eyebrow-shaped ducts as shown in FIGS. 4–8 were to be tested in a water tunnel without gas flow, one would expect that the "chopped-off" trailing edge 68 of each eyebrow-shaped duct would produce additional drag (hereinafter "base drag"). However, when gas flow through the hollow stator vanes is established—with the gas flow velocity equal to or slightly less than the water stream velocity—the base drag vanishes. Thus, the placement of eyebrow-shaped exhaust ducts 66 over the exhaust outlets 64 eliminates both the directional mismatch and (with properly sized eyebrow-shaped ducts) the velocity mismatch.

In accordance with the preferred embodiment, the eyebrow-shaped ducts can be cut from a metal tube. Selection of the appropriate tube diameter to achieve an approximate match of gas velocity and water velocity (a velocity match) requires the designer to make reasonable estimates of the volume rate of exhaust gas being discharged by the engine and the speed at which the motor will be traveling. The gas exit velocity equals the volume rate of discharge in cubic feet divided by the total eyebrow exit area in square feet.

Figure 9:
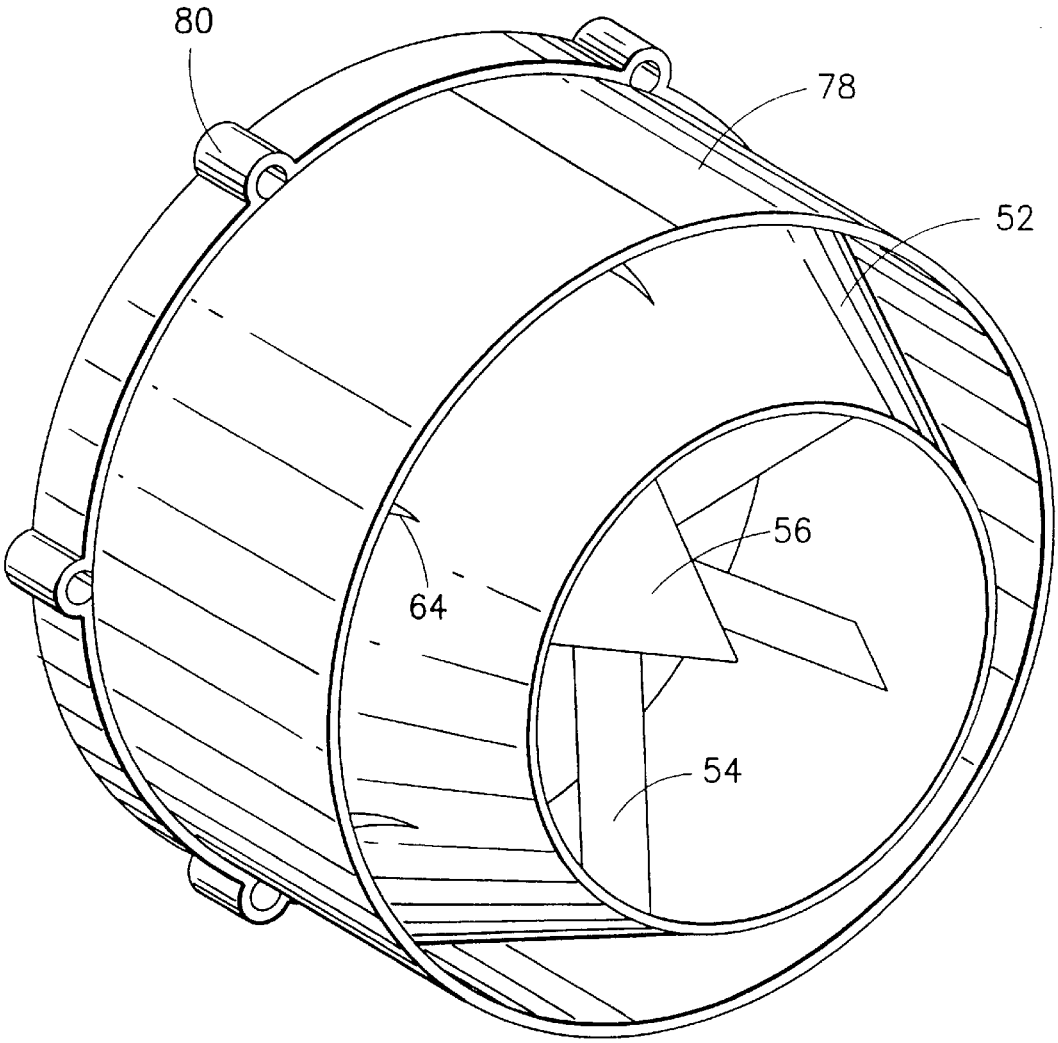
FIG. 9 is an isometric view of a stator housing with added exhaust skirt in accordance with another preferred embodiment of the invention.
Figure 10:
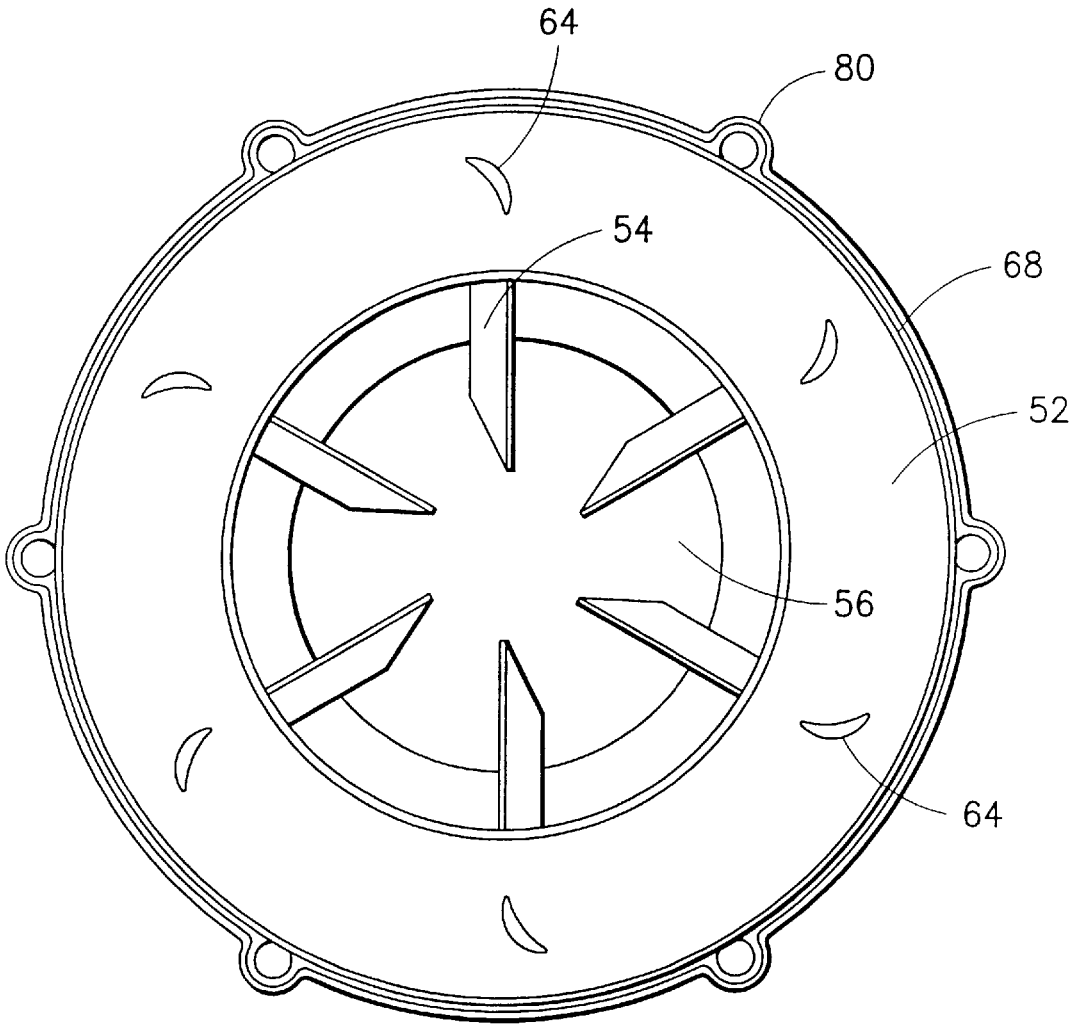
FIG. 10 is an end elevational view of the stator housing with added skirt shown in FIG. 9.

Another preferred embodiment of the invention is shown in FIGS. 9 and 10. In this embodiment, a circumferential exhaust skirt 78 is attached to the outer surface of the stator housing 52 at an axial position adjacent the stator housing bosses 80. One method of attaching the exhaust skirt comprises the following steps: (1) a circumferential portion of the conical outer surface of the stator housing is machined to be circular cylindrical; (2) a plurality of threaded bores are machined into the stator housing at locations circumferentially distributed at equal angular intervals within the machined area; (3) holes are formed in a circular cylindrical skirt made of sheet metal and having an inner radius slightly larger than the outer radius of the machined area on the stator housing (the holes being located so as to align with the threaded bores when the skirt is slid onto the stator housing); (4) the skirt is slid onto the stator housing until the holes in the skirt align with the threaded bores in the stator housing; and (5) the skirt is attached to the stator housing by tightly screwing screws into the threaded bores. Alternatively, the exhaust skirt 78 can be attached to the stator housing by any other suitable means, e.g., by tack welding.

The skirt 78 extends axially rearward to enshroud the exhaust gas outlets 64. Preferably the skirt does not extend to the outlet of the stator housing, i.e., the skirt is axially shorter than the stator housing, to ensure that exhaust gas will not be sucked into the stator housing when the pump jet is operating in reverse. Preferably the skirt 78 has a central axis coaxial with the central axis of the stator housing, i.e., central axis of the pump jet. The skirt may be either circular cylindrical or conical with radius decreasing in the rearward direction. Exhaust gases exiting the exhaust outlets at the outer surface of the stator housing 52 are redirected by the inner surface of the skirt 78 to flow in parallel with the water flow at the trailing edge of the skirt. The skirt 78 blocks "bushing out" of the exhaust gas stream flowing out of the exhaust outlets 64. In the case of a circular cylindrical skirt, the skirt. redirects the exhaust gas stream to be substantially parallel with the pump jet central axis. During pump jet propulsion of a watercraft, water flows axially rearward (relative to the moving pump jet) along the outer circumferential surface of the skirt 78, while the exhaust gas stream flows axially rearward along the inner circumferential surface of the skirt 78, thereby substantially eliminating directional mismatch of the respective flows at the trailing edge of the skirt. Alternatively, the skirt may be conical with decreasing radius in the rearward direction, the length of the skirt and its radius at the trailing edge being adjusted to reduce or eliminate velocity mismatch between the exhaust gas stream and the surrounding flow stream of water.

The invention has application in both outboard drive units and inboard/outboard or stern drive units for watercraft and other vehicles. A propulsor of a stern drive unit is typically mounted to the stern or transom of a boat hull via a transom mount assembly or bracket. The shaft on which the pump jet rotor is mounted is driven to rotate by an engine mounted inside the boat via conventional gear assemblies mounted outside the boat.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "conical" means having the shape of a truncated cone, the term "cylindrical" is not limited to circular cylinders, and the term "marine engine" includes both inboard and outboard motors.

What is claimed is:

1. A pump jet apparatus for a marine engine, comprising:

a rotor assembly having an axis of rotation and comprising a rotor hub having a channel for receiving exhaust gas from the motor;

a housing surrounding said rotor assembly and having an inlet and an outlet;

an exhaust plenum positioned rearwardly of said rotor hub and inside said housing, and in flow communication with said channel in said rotor hub;

a hollow member in flow communication with said exhaust plenum a nd having an exhaust outlet penetrating said housing; and a wall attached to said housing and overlying said exhaust outlet, wherein said wall and said housing define an opening which is in flow communication with said exhaust outlet, and said wall comprises a section of a cylindrical tube.

2. The pump jet apparatus as recited in claim 1, wherein said hollow member comprises a stator vane.

3. The pump jet apparatus as recited in claim 1, wherein said cylindrical tube is substantially parallel to said axis of rotation of said rotor assembly.

4. A pump jet apparatus for a marine engine, comprising:

a rotor assembly having an axis of rotation and comprising a rotor hub having a channel for receiving exhaust gas from the motor;

a housing surrounding said rotor assembly and having an inlet and an outlet;

an exhaust plenum positioned rearwardly of said rotor hub and inside said housing, and in flow communication with said channel in said rotor hub;

a hollow member in flow communication with said exhaust plenum and having an exhaust outlet penetrating said housing; and a wall attached to said housing and overlying said exhaust outlet, wherein said wall and said housing define an opening which is in flow communication with said exhaust outlet, and said wall comprises a cylindrical skirt circumferentially surrounding a portion of said housing.

5. The pump jet apparatus as recited in claim 4, wherein said cylindrical skirt has a trailing edge located upstream of a trailing edge of said housing.

6. A pump jet apparatus for a marine engine, comprising:

a rotor assembly having an axis of rotation and comprising a rotor hub having a channel for receiving exhaust gas from the motor;

a housing surrounding said rotor assembly and having an inlet and an outlet;

an exhaust plenum positioned rearwardly of said rotor hub and inside said housing, and in flow communication with said channel in said rotor hub;

a hollow member in flow communication with said exhaust plenum and having an exhaust outlet penetrating said housing; and a wall attached to said housing and overlying said exhaust outlet, wherein said wall and said housing define an opening which is in flow communication with said exhaust outlet, and said wall comprises a conical skirt circumferentially surrounding a portion of said housing.

7. The pump jet apparatus as recited in claim 6, wherein said conical skirt has a trailing edge located upstream of a trailing edge of said housing.

8. A pump jet apparatus for a marine engine, comprising:

a rotor assembly having an axis of rotation and comprising a rotor hub having a channel for receiving exhaust gas from the motor;

a rotor housing surrounding said rotor assembly and having an inlet and an outlet;

a stator housing coupled to said rotor housing and having an inlet and an outlet, said inlet of said stator housing being in flow communication with said outlet of said rotor housing;

an exhaust plenum positioned rearwardly of said rotor hub and inside said stator housing, and in flow communication with said channel in said rotor hub;

first and second hollow members in flow communication with said exhaust plenum and having first and second exhaust outlets respectively, said first and second exhaust outlets penetrating said stator housing at first and second locations respectively; and first and second exhaust ducts attached to said stator housing and overlying said first and second exhaust outlets respectively, wherein said first and second exhaust ducts and said stator housing define first and second openings respectively which are in flow communication with said first and second exhaust outlets respectively, and each of said first and second exhaust ducts comprises a respective section of a cylindrical tube.

9. The pump jet apparatus as recited in claim 8, wherein each of said first and second hollow members comprises a respective stator vane.

10. The pump jet apparatus as recited in claim 8, wherein said first and second exhaust ducts are substantially parallel to said axis of rotation of said rotor assembly.

11. A pump jet apparatus for a marine engine, comprising:

a rotor assembly having an axis of rotation and comprising a rotor hub having a channel for receiving exhaust gas from the motor;

a rotor housing surrounding said rotor assembly and having an inlet and an outlet;

a stator housing coupled to said rotor housing and having an inlet and an outlet, said inlet of said stator housing being in flow communication with said outlet of said rotor housing;

an exhaust plenum positioned rearwardly of said rotor hub and inside said stator housing, and in flow communication with said channel in said rotor hub;

first and second hollow members in flow communication with said exhaust plenum and having first and second exhaust outlets respectively, said first and second exhaust outlets penetrating said stator housing at first and second locations respectively; and an exhaust skirt attached to and surrounding a portion of said stator housing and overlying said first and second exhaust outlets respectively, wherein said exhaust skirt and said stator housing define an annular opening which is in flow communication with said first and second exhaust outlets.

12. The pump jet apparatus as recited in claim 1, wherein each of said first and second hollow members comprises a respective stator vane.

13. The pump jet apparatus as recited in claim 11, wherein said exhaust skirt is a cylinder having a trailing edge located upstream of a trailing edge of said stator housing.

14. The pump jet apparatus as recited in claim 11, wherein said exhaust skirt is a truncated cone having a trailing edge located upstream of a trailing edge of said stator housing.

15. A pump jet apparatus for a marine engine, comprising:

a rotor assembly having an axis of rotation and comprising a rotor hub having a channel for receiving exhaust gas from the motor;

a housing surrounding said rotor assembly and having an inlet and an outlet;

an exhaust plenum positioned rearwardly of said rotor hub and inside said housing, and in flow communication with said channel in said rotor hub;

a hollow member in flow communication with said exhaust plenum and having an exhaust outlet penetrating said housing; and means for redirecting exhaust gas exiting said exhaust outlet in a direction substantially parallel to said axis of rotation of said rotor assembly, wherein said redirecting means and said housing define an opening which is in flow communication with said exhaust outlet.

16. The pump jet apparatus as recited in claim 15, wherein said hollow member comprises a stator vane.

17. The pump jet apparatus as recited in claim 15, wherein said redirecting means are attached to said housing.

18. An apparatus for propelling a watercraft, comprising:

a powerhead which produces exhaust gas;

a powerhead exhaust channel in flow communication with said powerhead for receiving exhaust gas therefrom;

a rotor assembly comprising a rotor hub having a hub exhaust channel in flow communication with said powerhead exhaust channel;

a housing surrounding said rotor assembly and having an inlet and an outlet;

an exhaust plenum positioned rearwardly of said rotor hub and inside said housing, and in flow communication with said channel in said rotor hub;

a hollow member in flow communication with said exhaust plenum and having an exhaust outlet penetrating said housing; and means for redirecting exhaust gas exiting said exhaust outlet in a direction substantially parallel to said axis of rotation of said rotor assembly, wherein said redirecting means and said housing define an opening which is in flow communication with said exhaust outlet.

19. The apparatus as recited in claim 18, wherein said hollow member comprises a stator vane.

20. The apparatus as recited in claim 18, wherein said redirecting means are attached to said housing.

* * * * *